US005140638A

United States Patent [19]

Moulsley et al.

[11] Patent Number: 5,140,638

[45] Date of Patent: Aug. 18, 1992

[54] SPEECH CODING SYSTEM AND A METHOD OF ENCODING SPEECH

[75] Inventors: Timothy J. Moulsley, Caterham; Patrick W. Elliott, Nutfield, both of Great Britain

[73] Assignee: U.S. Philips Corporation, New York, N.Y.

[21] Appl. No.: 563,473

[22] Filed: Aug. 6, 1990

[30] Foreign Application Priority Data

Aug. 16, 1989 [GB] United Kingdom ..... 8918677

[51] Int. Cl.[5] ..... G10L 5/00

[52] U.S. Cl. ..... 381/36; 381/31

[58] Field of Search ..... 381/31, 36; 395/2

[56] References Cited

PUBLICATIONS

Bottau, et al, "On Different Vector Predictive Coding etc", Eurasip, 1988, pp. 871-874.

Adoul, et al, "Fast CELP Coding Based on Algebraic Codes," ICASSP, 1987, pp. 1957-1960.

Lin, "Speech Coding etc," ICASSP, 1987, pp. 1354-1357.

*Primary Examiner*—Emanuel S. Kemeny

*Attorney, Agent, or Firm*—Bernard Franzblau

[57] ABSTRACT

A speech coding system of the code excited linear prediction (CELP) type includes apparatus (24,26) for filtering digitized speech samples to form perceptually weighted speech samples. Entries in a one-dimensional codebook (110) comprising frame length sequences are filtered in a perceptually weighted synthesis filter (28) to form a one-dimensional filtered codebook. The filtered codebook entries are compared with the perceptually weighted speech signals to obtain a codebook index which gives the minimum perceptually weighted error when the speech is resynthesized. Using a one-dimensional codebook (110) reduces the amount of computation which is required compared to the use of a two-dimensional codebook.

34 Claims, 2 Drawing Sheets

SPEECH CODING SYSTEM AND A METHOD OF ENCODING SPEECH

Background of the Invention

The present invention relates to a speech coding system and to a method of encoding speech and more particularly to a code excited speech coder which has application in digitised speech transmission systems.

When transmitting digitised speech a problem which occurs is how to obtain high quality speech over a bandwidth limited communications channel. In recent years a promising approach to this problem involves Code-Excited Linear Prediction (CELP) which is capable of producing high quality synthetic speech at a low bit rate. FIG. 1 of the accompanying drawings is a block schematic diagram of a proposal for implementing CELP and is disclosed, for example, in a paper "Fast CELP Coding Based on Algebraic Codes" by J-P Adoul, P. Mabilleau, M. Delprat and S. Morissette and read at the International Conference on Acoustics Speech and Signal Processing (ICASSP) 1987 and reproduced on pages 1957 to 1960 of ICASSP87. In summary, CELP is a speech coding technique in which a residual signal is represented by an optimum temporal waveform of a code-book with respect to subjective error criteria. More particularly, a codebook sequence $c_k$ is selected which minimizes the energy in a perceptually weighted signal y(n) by, for example, using Mean Square Error (MSE) criteria to select the sequence. In FIG. 1 a two-dimensional code-book 10 which stores random vectors $c_k(n)$ is coupled to a gain stage 12. The signal output $\hat{r}(n)$ from the gain stage 12 is applied to a first inverse filter 14 constituting a long term predictor and having a characteristic 1/B(z), the filter 14 being used to synthesize pitch. A second inverse filter 16 constituting a short term predictor and having a characteristic 1/A(z) is connected to receive the output $\hat{e}(n)$ of the first filter 14. The second filter synthesizes the spectral envelope and provides an output $\hat{s}(n)$ which is supplied to an inverting input of a summing stage 18. A source of original speech 20 is connected to a non-inverting input of the summing stage 18. The output x(n) of the summing stage is applied to a perceptual weighting filter 22 having a characteristic W(z) and providing an output y(n).

In operation the comparatively high quality speech at a low bit rate is achieved through an analysis-by-synthesis procedure using both short-term and long-term prediction. This procedure consists of finding the best sequence in the code-book which is optimum with respect to a subjective error criterion. Each code word or sequence $c_k$ is scaled by an optimum gain factor $G_k$ and is processed through the first and second inverse filters 14, 16. The difference x(n) between the original and the synthetic signals, that is s(n) and $\hat{s}(n)$, is processed through the perceptual weighting filter 22 and the "best" sequence is then chosen to minimize the energy of the perceptual error signal y(n). Two reported criticisms of the proposal shown in FIG. 1 are the large number of computations arising from the search procedure to find the best sequence and the computations required from filtering of all the sequences through both long-term and short-term predictors.

The above-mentioned paper reproduced on pages 1957 to 1960 of ICASSP 87 proposes several ideas for reducing the amount of computation.

A block schematic implementation of one of these ideas is shown in FIG. 2 of the accompanying drawings in which the same reference numerals have been used as in FIG. 1 to indicate corresponding parts. This implementation is derived by expressing the perceptual weighting filter 22 (FIG. 1) as $$W(z)=A(z)/A(z/\gamma)$$

where $\gamma$ is the perceptual weighting coefficient (chosen around 0.8) and A(z) is a linear prediction filter:

$$A(z)=\Sigma_i a_i z^{-i}.$$

Compared to FIG. 1, the perceptual weighting filter W(z) is moved to the signal input paths to the summing stage 18. Thus, the original speech from the source 20 is processed through an analysis filter 24 having a characteristic A(z) yielding a residual signal e(n) from which pitch parameters are derived. The residual signal e(n) is processed through an inverse filter 26 having a characteristic $1/A(z/\gamma)$. which yields a signal s'(n) which is applied to the non-inverting input of the summing stage 18.

In the other signal path, the short term predictor constituted by the second inverse filter 16 (FIG. 1) is replaced by an inverse filter 28 having a characteristic $1/A(z/\gamma)$ which produces an output $\hat{s}'(n)$.

The long term predictor, the filter 14, can be chosen to be a single tap predictor:

$$B(z)=1-bz^{-T} \tag{1}$$

where b is the gain and T is called the pitch period. The expression for the output signal $\hat{e}(n)$ of the pitch predictor 1/B(z) can be derived from the above equation (1)

$$\hat{e}(n)=r(\hat{n})+\hat{b}e(n-T) \tag{2}$$

where $r(n)=G_k c_k(n)$, where n=0, N−1 and N is the block size or length of the codewords, where k is the codebook index and $G_k$ is a gain factor.

During the search procedure, the signal $\hat{e}(n-T)$ is known and does not depend on the codeword currently being tested if T is constrained to be always greater than N. Thus it is possible for the pitch predictor 1/B(z) to be removed from the signal path from the two-dimensional codebook 10 if the signal $b\hat{e}(n-T)$ is subtracted from the residual signal in the path from the speech source 20. Using expression (2), the signal $\hat{e}(n-T)$ is obtained by processing the delayed signal r(n−T) through the pitch predictor 1/B(z); and $\hat{r}_{n-T}$ is computed from already known codewords, chosen for preceding blocks, provided that the pitch period T is restricted to values greater than the block size N. The operation of the pitch predictor can also be considered in terms of a dynamic adaptive codebook.

This paper also discloses a scheme whereby the long term predictor 1/B(z) and the memory of the short-term predictor $1/A(z/\gamma)$ are removed from the signal path from the codebook 10. As a consequence, it is possible to reduce two filtering operations on each codeword to a single memoryless filtering per codeword with a significant reduction in the computational load.

Another paper, "On Different Vector Predictive Coding Schemes and Their Application to Low Bit Rates Speech Coding" by F. Bottau, C. Baland, M. Rosso and J. Menez, pages 871 to 874 of EURASIP 1988, discloses an approach for CELP coding which allows the speech quality to be maintained, assuming a given level of computational complexity, without increasing the memory size. However, as this paper is less relevant to an understanding of the present invention than the ICASSP 87 paper, it will not be discussed in detail.

Although both these papers described methods of improving the implementation of the CELP technique, there is still room for improvement.

Summary of the Invention

According to a first aspect of the present invention, there is provided a speech coding system comprising means for filtering digitised speech samples to form perceptually weighted speech samples, a one-dimensional codebook, means for filtering entries read-out from the codebook, and means for comparing the filtered codebook entries with the perceptually weighted speech signals to obtain a codebook index which gives the minimum perceptually weighted error when the speech is resynthesized.

According to a second aspect of the present invention, there is provided a method of encoding speech in which digitised speech samples are filtered to produce perceptually weighted speech samples, entries are selected from a one-dimensional code book and are filtered to form a filtered codebook, and the perceptually weighted speech samples are compared with entries from the filtered codebook to obtain a codebook index which gives the minimum perceptually weighted error when the speech is resynthesized.

By using a one-dimensional codebook a significant reduction in the computational load of the CELP coder is achieved because the processing consists of filtering this codebook in its entirety using the perceptually weighted synthesis filter once for each set of filter coefficients produced by linear predictive analysis of the digitised speech samples. The updating of the filter coefficients may be once every four frames of digitised speech samples, each frame having a duration of for example 5mS. The filtered codebook is then searched to find the optimum framelength sequence which minimizes the error between the perceptually weighted input speech and the chosen sequence.

If desired, every pth entry of the filtered codebook may be searched, where p is greater than unity. As adjacent entries in the filtered codebook are correlated, then by not searching each entry the computational load can be reduced without unduly affecting the quality of the speech or alternatively, a longer codebook can be searched for the same computational load giving the possibility of better speech quality.

In an embodiment of the present invention the comparison is effected by calculating the sum of the cross products using the equation:

$$E_k = \sum_{n=0}^{N-1} x^2(n) - \frac{\left(\sum_{n=0}^{N-1} x(n)g_k(n)\right)^2}{\sum_{n=0}^{N-1} g_k^2(n)}$$

where $E_k$ is the overall error term,

N is the number of digitised samples in a frame, n is the sample number, x is the signal being matched with the codebook, $g_k$ is the unscaled filtered codebook sequence, and k is the codebook index This is equivalent to searching the codebook index k for a maximum of the expression:

$$\frac{\left(\sum_{n=0}^{N-1} x(n)g_k(n)\right)^2}{\sum_{n=0}^{N-1} g_k^2(n)}$$

The computation can be reduced (at some cost in speech quality) by evaluating every mth term of this cross product and maximising $$\frac{\left(\sum_{n=0}^{\frac{N}{m}-1} x(nm)g_k(nm)\right)^2}{\sum_{n=0}^{\frac{N}{m}-1} g_k^2(nm)}$$

where m is an integer having a low value.

The speech coding system may further comprise means for forming a long term predictor using a dynamic adaptive codebook comprising scaled entries selected from the filtered codebook together with entries from the dynamic adaptive codebook, means for comparing entries from the dynamic adaptive codebook with perceptually weighted speech samples, means for determining an index which gives the smallest difference between the dynamic adaptive codebook entry and the perceptually weighted speech samples, means for subtracting the determined entry from the perceptually weighted speech samples, and means for comparing the difference signal obtained from the subtraction with entries from the filtered codebook to obtain the filtered codebook index which gives the best match.

Means may be provided for combining the filtered codebook entry which gives the best match with the corresponding dynamic adaptive codebook entry to form coded perceptually weighted speech samples, and for filtering the coded perceptually weighted speech samples to provide synthesized speech.

The dynamic adaptive codebook may comprise a first-in, first-out storage device of predetermined capacity, the input signals to the storage device comprising the coded perceptually weighted speech samples.

The filtering means for filtering the coded perceptually weighted samples may comprise means for producing an inverse transfer function compared to the transfer function used to produce the perceptually weighted speech samples.

According to a third aspect of the present invention, there is provided a method of deriving speech comprising; forming a filtered codebook by filtering a one dimensional codebook using a filter whose coefficients are specified in an input signal, selecting a predetermined sequence specified by a codebook index in the input signal, adjusting the amplitude of the selected predetermined sequence in response to a gain signal contained in the input signal, restoring the pitch of the selected predetermined sequence in response to pitch predictor index and gain signals contained in the input signal, and applying the pitch restored sequence to deweighting and inverse synthesis filters to produce a speech signal.

BRIEF DESCRIPTION OF THE DRAWING

The present invention will now be described, by way of example, with reference to the accompanying drawings, wherein.

In the drawings the same reference numerals have been used to identify corresponding features.

DESCRIPTION OF THE PREFERRED EMBODIMENTS

Figure 3:
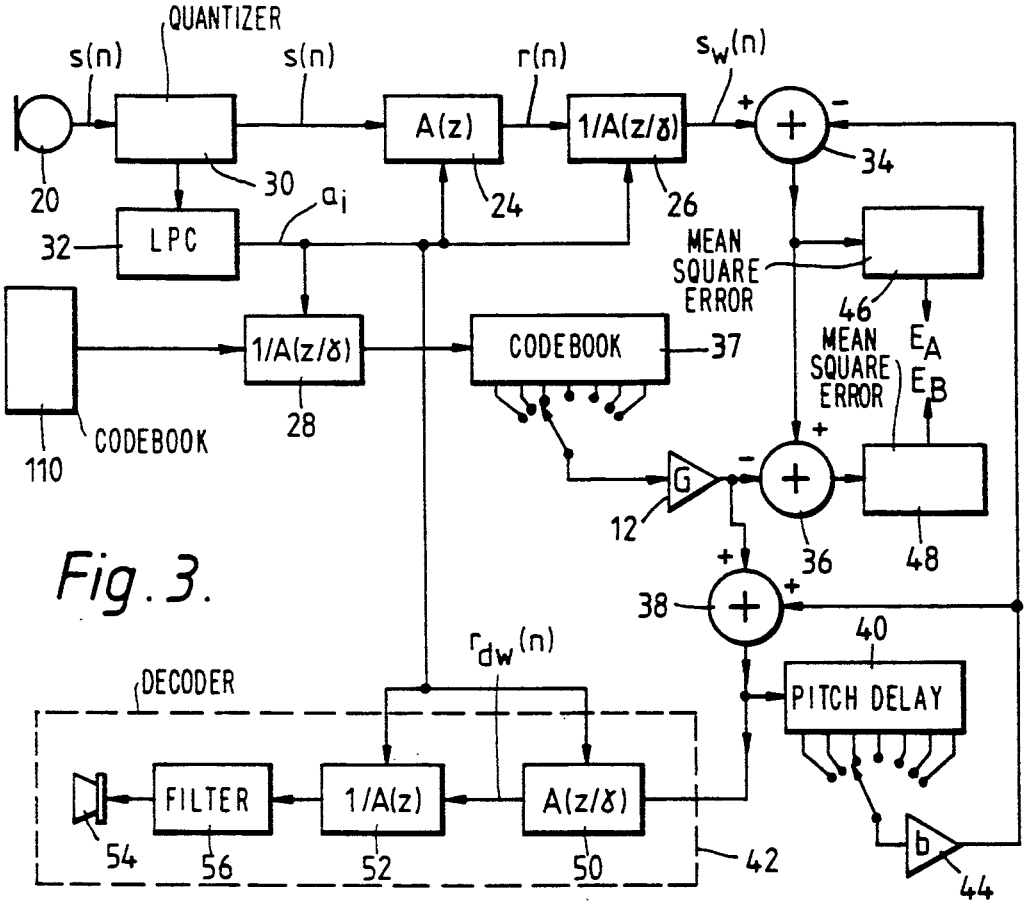
FIG. 3 is a block schematic diagram of an embodiment of the present invention.

Referring to FIG. 3, a speech source 20 is coupled to a stage 30 which quantizes the speech and segments it into frames of 5mS duration. The segmented speech s(n) is supplied to an analysis filter 24 having a transfer function A(z) and to a linear predictive coder (LPC) 32 which calculates the filter coefficients $a_i$. The residual signal r(n) from the filter 24 is then processed in a perceptually weighted synthesis filter 26 having a transfer function $1/A(z/\gamma)$. The perceptually weighted residual signal $s_w(n)$ is applied to a non-inverting input of a subtracting stage 34 (which is implemented as a summing stage having inverting and non-inverting inputs). The output of the summing stage 34 is supplied to the non-inverting input of another subtracting stage 36.

A one dimensional (1-D) codebook 110 containing white Gaussian random number sequences is connected to a perceptually weighted synthesis filter 28 which filters the codebook entries and supplies the results to a 1-D filtered codebook 37 which constitutes a temporal master codebook. The codebook sequences are supplied in turn to a gain stage 12 having a gain G. The scaled coded sequences from the gain stage 12 are applied to the inverting input of the subtracting stage 36 and to an input of a summing stage 38. The output of the stage 38 comprises a pitch prediction signal which is applied to pitch delay stage 40, which introduces a preselected delay T, and to a stage 42 for decoding the speech. The pitch delay stage 40 may comprise a first-in, first-out (FIFO) storage device. The delayed pitch prediction signal is applied to a gain stage 44 which has a gain b. The scaled pitch prediction signal is applied to an input of the summing stage 38 and to an inverting input of the subtracting stage 34.

A first mean square error stage 46 is also connected to the output of the subtracting stage 34 and provides and error signal $E_A$ which is used to minimize variance with respect to pitch prediction. A second mean square error stage 48 is connected to the output of the subtracting stage 36 to produce a perceptual error signal $E_B$ which is used to minimize the variance with respect to the filtered codebook 37.

In the illustrated embodiment, speech from the source 20 is segmented into frames of 40 samples, each frame having a duration of 5mS. Each frame is passed through the analysis and weighting filters 24, 26. The coefficients $a_i$ for these filters are derived by linear predictive analysis of the digitised speech samples. In a typical application, ten prediction coefficients are required and these are updated every 20mS (the block rate). The weighting filter introduces some subjective weighting into the coding process. A value of $\gamma=0.65$ has been found to give good results. In the subtracting stage 34, the scaled (long term) pitch prediction is subtracted from the perceptually weighted residual signals $s_w(n)$ from the filter 26. As long as the scaled pitch prediction uses only information from previously processed speech, the optimum pitch delay T and gain b (stage 44) can be calculated to minimize the error $E_A$ at the output of the MSE stage 46.

The 1-D codebook 110 comprises 1024 elements all of which are filtered once per 20mS block by the perceptual weighting filter 28, the coefficients of which correspond to those of the filter 26. The codebook search is carried-out by examining vectors composed of 40 adjacent elements from the filtered codebook 37. During the search the starting position of the vector is incremented by one or more for each codebook entry and the value of the gain G (stage 12) is calculated to give the minimum error $E_B$ at the output of the MSE 48. Thus, the codebook index and the gain G for the minimum perceptual error are found. This information is then used in the synthesis of the output speech using, for example, the stage 42 which comprises a deweighting analysis filter 50, and inverse synthesis filter 52, an output transducer 54, and optionally, a global post filter 56. The coefficients of the filters 50 and 52 are derived from the LPC 32. In a practical situation the information transmitted comprises the LPC coefficients, the codebook index, the codebook gain, the pitch predictor index and the pitch predictor gain. At the end of a communications link, a receiver having a copy of the unfiltered 1-D codebook can regenerate the filtered codebook for each speech block from the received filter coefficients and can then synthesize the original speech.

In order to reduce the number of bits required to represent the LPC coefficients, these coefficients were quantized as log-area ratios (L.A.R.'s) which also minimized their sensitivity to quantisation distortion. Alternatively these coefficients may be quantizied by using line spectral pairs (LSP) or using inverse sine coefficients. In the present example a block of 10 LPC coefficients quantized as LARs can be represented as 40 bits per 20mS. The figure of 40 bits is made-up by quantizing the 1st and 2nd LPC coefficients using 6 bits each, the 3rd and 4th LPC coefficients using 5 bits each, the 5th and 6th LPC coefficients using 4 bits each, the 7th and 8th LPC coefficients using 3 bits each and the 9th and 10th LPC coefficients using 2 bits each. Thus the number of bits per second is 2000. Additionally, the frame rate which is updated once every 5mS comprises codebook index - 10 bits, codebook gain, which has been quantised logarithmically, -5 bits +1 sign bit, pitch predictor index −7 bits and pitch predictor gain −4 bits. This totals 27 bits which corresponds to 5400 bits per second. Thus the total bit rate (2000 + 5400) is 7400 bits per second.

Figure 1:
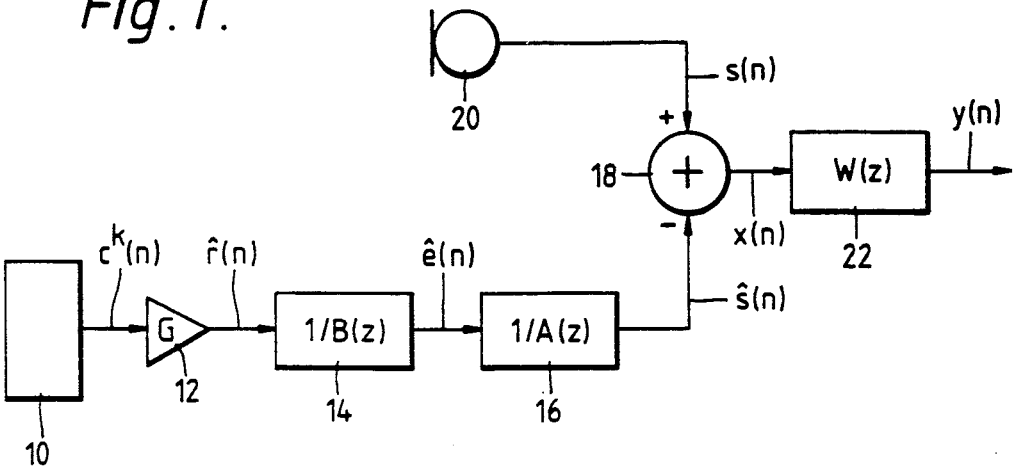
FIGS. 1 and 2 are block schematic diagrams of known CELP systems.
Figure 2:
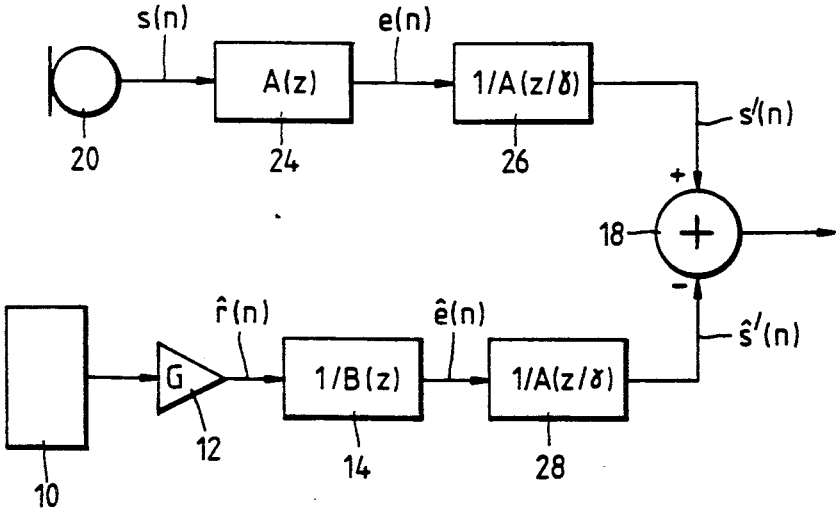

The two-dimensional codebook disclosed in FIGS. 1 and 2 could be represented by:

$$c(i,j)=d(i,j)$$

where c(i,j) is the j'th element of the i'th codebook entry and d is a 2-dimensional array of random numbers. In contrast the codebook used in FIG. 3 can be represented by $$c(i,j)=d(i+j)$$

where d is a 1-dimensional array of random numbers. Typically $1<i<1024$ and $1<j<40$.

Thus, the prior art two-dimensional codebook is replaced by a codebook with elements taken from a one-dimensional array in a way such that successive codebook entries can overlap and have a significant numbers of values in common. The one-dimensional codebook thus is equivalent, but not identical, to the original two-dimensional codebook in terms of its statistical and frequency domain spectral properties. More specifically, the required degree of similarity is equally achieved if the two codebooks are generated from the same stochastic signal source and filtered using the same filter coefficients.

The bulk of the calculation in CELP lies in the codebook search, and a considerable amount of this is involved with filtering the codebook. Using a 1-dimensional codebook as described with reference to FIG. 3 reduces the codebook filtering by a factor equal to the length of the speech segment.

The comparison of the filtered codebook sequences with the pitchless perceptually weighted residual on the output of the subtracting stage 34 is carried out by calculating the sum of the cross-products using the equation:

$$E_k = \sum_{n=0}^{N-1} x^2(n) - \frac{\left(\sum_{n=0}^{N-1} x(n)g_k(n)\right)^2}{\sum_{n=0}^{N-1} g_k^2(n)}$$

where

E is the overall error term,

N is the number of digitised samples in a frame, n is the sample number, x is the signal being matched with the codebook, $g_k$ is the unscaled filtered codebook sequence, and k is the codebook index.

The derivation of this equation is based on the equations given on page 872 of the EURASIP, 1988 referred to above.

Figure 4:
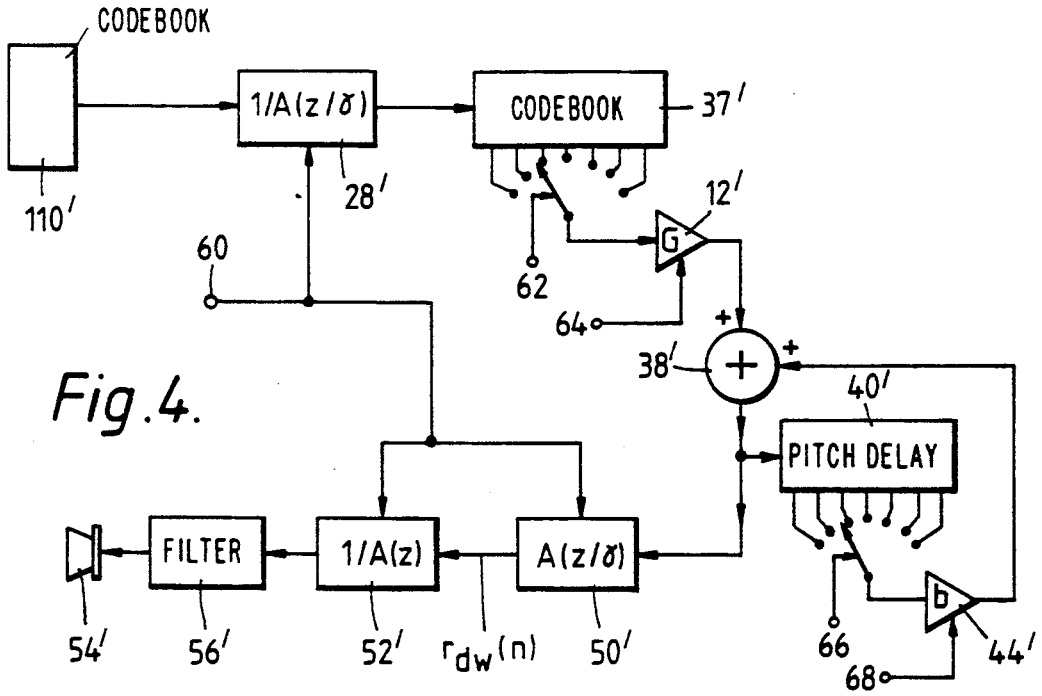
FIG. 4 is a block schematic diagram of a receiver.

For the sake of completeness, FIG. 4 illustrates a receiver. As the receiver comprises features which are also shown in the embodiment of FIG. 3, the corresponding features have been identified by primed reference numerals. The data received by the receiver will comprise the LPC coefficients which are applied to a terminal 60, the codebook index and gain which are respectively applied to terminals 62, 64, and the pitch predictor index and gain which are respectively applied to terminals 66, 68. A one dimensional codebook 110' is filtered in a perceptually weighted synthesis filter 28' and the outputs are used to form a filtered codebook 37'. The appropriate sequence from the filtered codebook 37' is selected in response to the codebook index signal and is applied to a gain stage which has its gain specified in the received signal. The gain adjusted sequence is applied to the pitch predicator 40' whose delay is adjusted by the pitch predictor index and the output is applied to a gain stage 44' whose gain is specified by the pitch predictor gain signal. The sequence with the restored pitch prediction is applied to a deweighting analysis filter 50' having a characteristic $A(z/\gamma)$. The output $r_{dw}(n)$ from the filter 50' is applied to an inverse synthesis filter 52' which has a characteristic $1/A(z)$. The coefficients for the filters 50', 52' are specified in the received signal and are updated every block (or four frames). The output of the filter 52' can be applied directly to an output transducer 54' or indirectly via a global post filter 56' which enhances the speech quality by enhancing the noise suppression at the expense of some speech distortion.

The embodiment illustrated in FIG. 3 may be modified in order to simplify its construction, to reduce the degree of computation or to improve the speech quality without increasing the amount of computation.

For example, the analysis and weighting filters may be combined.

The size of the 1-dimensional codebook may be reduced.

The perceptual error estimation may be carried out on a sub-sampled version of the perceptual error signal. This would reduce the calculation required for the long term predicator and also in the codebook search.

A full search of the filtered codebook may not be needed since adjacent entries are correlated. Alternatively, a longer codebook could be searched to give better speech quality. In either case every pth entry is searched, where p is greater than unity.

Filtering computation could be reduced if two half length codebooks were used. One could be filtered with the weighting filter from the current frame, the other could be retained from the previous frame. Similarly, one of these half length codebooks could be derived from previously selected codebook entries.

If desired a fixed weighting filter may be used for filtering the codebook.

The embodiment of the invention shown in FIG. 3 assumes that the transfer functions of the perceptually weighted synthesis filters 26, 28 are the same. However, it has been found that it is possible to achieve improved speech quality by having different transfer functions for these filters. More particularly, the value of $\gamma$ for the filters 26 and 50 is the same but different from that of the filter 28.

The numerical values given in the description of the operation of the embodiment in FIG. 3 are by way of illustration and other values may be used without departing from the scope of the invention, as claimed.

From reading the present disclosure, other modifications will be apparent to persons skilled in the art. Such modifications may involve other features which are already known in the design, manufacture and use of CELP systems and component parts thereof and which may be used instead of or in addition to features already described herein. Although claims have been formulated in this application to particular combinations of features, it should be understood that the scope of the disclosure of the present application also includes any novel feature or any novel combination of features disclosed herein either explicitly or implicitly or any variation thereof, whether or not it relates to the same invention as presently claimed in any claim and whether or not it mitigates any or all of the same technical problems as does the present invention.

We claim:

1. A speech coding system comprising; means for filtering digitised speech samples to form perceptually weighted speech signal samples, a one-dimensional codebook, means for filtering entries read-out from the codebook, and means for comparing the filtered codebook entries with the perceptually weighted speech signals to obtain a codebook index which gives the minimum perceptually weighted error when the speech is resynthesised.

2. A system as claimed in claim 1, wherein the means for filtering the codebook entries comprises a perceptual weighting filter.

3. A system as claimed in claim 2, wherein the means for filtering the digitised speech signal samples comprises a short term predictor and a further perceptual weighting filter connected in cascade, and means for deriving coefficients for the short term predictor and for the further perceptual weighting filter by linear predictive analysis of the digitised speech samples.

4. A system as claimed in claim 3, wherein the transfer functions of the perceptual weighting filter and the further perceptual weighting filter are different.

5. A system as claimed in claim 4, wherein the means for comparing the filtered codebook entries with the perceptually weighted speech signals is adapted to search every pth entry, where p is greater than unity.

6. A system as claimed in claim 1, wherein said comparing means effects a comparison by calculating the sum of the cross products using the expression:

$$\frac{\left(\sum_{n=0}^{\frac{N}{m}-1} x(nm)g_k(nm)\right)^2}{\sum_{n=0}^{\frac{N}{m}-1} g_k^2(nm)}$$

where

N is the number of digitised samples in a frame,
n is the sample number,
x is the signal being matched with the codebook,
m is an integer having a low value
$g_k$ is the unscaled filtered codebook sequence, and
k is the codebook index.

7. A system as claimed in claim 1 further comprising means for forming a dynamic adaptive codebook from scaled entries selected from the filtered codebook, means for comparing entries from the dynamic adaptive codebook with perceptually weighted speech samples, means for determining an index which gives a smallest difference between the dynamic adaptive codebook entry and the perceptually weighted speech samples, means for subtracting the determined index from the perceptually weighted speech samples, and means coupled to the subtracting means for determining a filtered codebook index which gives the best match.

8. A system as claimed in claim 7, further comprising means for combining the filtered codebook entry which gives the best match with the corresponding dynamic adaptive codebook entry to form coded perceptually weighted speech samples, and means for filtering the coded perceptually weighted speech samples to provide synthesised speech.

9. A system as claimed in claim 8, wherein the dynamic adaptive codebook comprises a first-in, first out storage device of predetermined capacity and in that input signals to the storage device comprise the coded perceptually weighted speech samples.

10. A system as claimed in claim 9, wherein the means for filtering the coded perceptually weighted speech samples comprise means for producing an inverse transfer function compared to the transfer function used to produce the perceptually weighted speech samples.

11. A method of encoding speech which comprises: filtering digitised speech samples to produce perceptually weighted speech samples, selecting entries from a 1-dimensional code book and filtering same to form a filtered codebook, and comparing the perceptually weighted speech samples with entries from the filtered codebook to obtain a codebook index which gives the minimum perceptually weighted error when the speech is resynthesised.

12. A method as claimed in claim 11, wherein the codebook entries are filtered using a perceptual weighting filter.

13. A method as claimed in claim 12, wherein the digitised speech samples are filtered using a short term predictor and a further perceptual weighting filter, and deriving coefficients for the short term predictor and for the further perceptual weighting filter by linear predictive analysis of the digitised speech samples.

14. A method as claimed in claim 13, wherein the transfer functions of the perceptual weighting filters are different.

15. A method as claimed in claim 14, which comprises searching every pth filtered codebook entry, where p is greater than unity.

16. A method as claimed in claim 13 wherein the comparison of the perceptually weighted speech samples with entries from the filtered codebook comprises calculating the sum of the cross products using the expression $$\frac{\left(\sum_{n=0}^{\frac{N}{m}-1} x(nm)g_k(nm)\right)^2}{\sum_{n=0}^{\frac{N}{m}-1} g_k^2(nm)}$$

where

N is the number of digitised samples in a frame,
n is the sample number,
x is the signal being matched with the codebook,
$g_k$ is the unscaled filtered codebook sequence,
k is the codebook index, and
m is an integer having a low value.

17. A method as claimed in claim 11 which comprises forming a dynamic adaptive codebook from scaled entries selected from the filtered codebook, comparing entries from the dynamic adaptive codebook with perceptually weighted speech samples, determining an index which gives the smallest difference between the dynamic adaptive codebook entry and the perceptually weighted speech samples, subtracting the determined entry from the perceptually weighted speech samples and comparing the difference signal obtained by the subtraction with entries from the filtered codebook to obtain the filtered codebook index which gives the best match.

18. A method as claimed in claim 17, which comprises combining the filtered codebook entry which gives the best match with the corresponding dynamic adaptive codebook entry to form coded perceptually weighted speech samples, and filtering the coded perceptually weighted speech samples to provide synthesised speech.

19. A method as claimed in claim 18, wherein the coded perceptually weighted samples are filtered using a transfer function which is the inverse of the transfer function used to produce the perceptually weighted speech samples.

20. A method of deriving speech comprising: forming a filtered codebook by filtering a one dimensional codebook using a filter whose coefficients are specified in an input signal, selecting a predetermined sequence specified by a codebook index in the input signal, adjusting the amplitude of the selected predetermined sequence in response to a gain signal contained in the input signal, restoring the pitch of the selected predetermined sequence in response to pitch predictor index and gain signals contained in the input signal, and applying the pitch restored sequence to deweighting and inverse synthesis filters to produce a speech signal.

21. A system as claimed in claim 1, wherein the means for filtering the digitised speech signal samples comprises a short term predictor and a further perceptual weighting filter, and means for deriving coefficients for the short term predictor and for the further perceptual weighting filter by linear predictive analysis of the digitised speech samples.

22. A system as claimed in claim 21, further comprising means for forming a dynamic adaptive codebook from scaled entries selected from the filtered codebook, means for comparing entries from the dynamic adaptive codebook with perceptually weighted speech samples, means for determining an index which gives a smallest difference between the dynamic adaptive codebook entry and the perceptually weighted speech samples, means for subtracting the determined index from the perceptually weighted speech samples, and means for comparing a difference signal obtained from the subtraction with entries from the filtered codebook to obtain the filtered codebook index which gives the best match.

23. A system as claimed in claim 22, further comprising means for combining the filtered codebook entry which gives the best match with the corresponding dynamic adaptive codebook entry to form coded perceptually weighted speech samples, and means for filtering the coded perceptually weighted speech samples to provide synthesised speech.

24. A system as claimed in claim 23, wherein the dynamic adaptive codebook comprises a first-in, first out storage device of predetermined capacity and in that input signals to the storage device comprise the coded perceptually weighted speech samples.

25. A system as claimed in claim 8, wherein the means for filtering the coded perceptually weighted speech samples comprise means for producing an inverse transfer function compared to the transfer function used to produce the perceptually weighted speech samples.

26. A method as claimed in claim 11, wherein the comparison of the perceptually weighted speech samples with entries from the filtered codebook comprises calculating the sum of the cross products using the expression $$\frac{\left(\sum_{n=0}^{\frac{N}{m}-1} x(nm)g_k(nm)\right)^2}{\sum_{n=0}^{\frac{N}{m}-1} g_k^2(nm)}$$

where

N is the number of digitised samples in a frame, n is the sample number, x is the signal being matched with the codebook, gk is the unscaled filtered codebook sequence, k is the codebook index, and m is an integer having a low value.

27. A method as claimed in claim 26, which comprises forming a dynamic adaptive codebook from scaled entries selected from the filtered codebook, comparing entries from the dynamic adaptive codebook with perceptually weighted speech samples, determining an index which gives the smallest difference between the dynamic adaptive codebook entry and the perceptually weighted speech samples, subtracting the determined entry from the perceptually weighted speech samples and comparing the difference signal obtained by the subtraction with entries from the filtered codebook to obtain the filtered codebook index which gives the best match.

28. A method as claimed in claim 27, which comprises combining the filtered codebook entry which gives the best match with the corresponding dynamic adaptive codebook entry to form coded perceptually weighted speech samples, and filtering the coded perceptually weighted speech samples to provide synthesised speech.

29. A method as claimed in claim 28, wherein the coded perceptually weighted samples are filtered using a transfer function which is the inverse of the transfer function used to produce the perceptually weighted speech samples.

30. A CELP-type speech coding system comprising:

means for deriving digitized speech signal samples, an analysis filter having a transfer function A(z) and coupled to an output of said speech signal deriving means, a first perceptually weighted synthesis filter having a transfer function $1/A(z/\gamma)$ and coupled to an output of the analysis filter, a linear predictive coder coupled to an output of said speech signal deriving means for calculating filter coefficients $a_i$, a one-dimensional codebook, means including a second perceptually weighted synthesis filter with a transfer function $1/A(z/\gamma)$ coupled to an output of the one-dimensional codebook for filtering entries read-out of said codebook to derive filtered codebook entries, means for supplying the coefficients $a_i$ of said linear predictive coder to said analysis filter and to said first and second perceptually weighted synthesis filters, and means for comparing the filtered codebook entries with the perceptually weighted speech signals supplied by said first perceptually weighted synthesis filter thereby to derive a codebook index which gives the minimum perceptually weighted error for a resynthesized speech sequence.

31. A coding system as claimed in claim 30 wherein said means for filtering read-out codebook entries further comprises;

a one-dimensional filtered codebook connected in cascade with said second perceptually weighted synthesis filter and with its output coupled to said comparing means via a scaling circuit.

32. A method as claimed in claim 11 wherein the digitized speech samples are filtered using a short term predictor and a perceptual weighting filter, and deriving coefficients for the short term predictor and for the perceptual weighting filter by linear predictive analysis of the digitized speech samples.

33. The method as claimed in claim 11 which comprises searching every pth filtered codebook entry, where p is greater than unity.

34. A system as claimed in claim 1 wherein the means for comparing the filtered codebook entries with the perceptually weighted speech signals is adapted to search every pth entry, where p is greater than unity.

* * * * *

US005140638B1

REEXAMINATION CERTIFICATE (3813th)

United States Patent [19]

Moulsley et al.

[11] B1 5,140,638

[45] Certificate Issued Jul. 20, 1999

[54] SPEECH CODING SYSTEM AND A METHOD OF ENCODING SPEECH

[75] Inventors: Timothy J. Moulsley, Caterham; Patrick W. Elliott, Nutfield, both of United Kingdom

[73] Assignee: U.S. Philips Corporation, New York, N.Y.

Reexamination Request:
No. 90/004,859, Dec. 5, 1997

Reexamination Certificate for:

| | |
|---|---|
| Patent No.: | **5,140,638** |
| Issued: | **Apr. 18, 1992** |
| Appl. No.: | **07/563,473** |
| Filed: | **Aug. 6, 1990** |

[30] Foreign Application Priority Data

Apr. 16, 1989 [GB] United Kingdom ..... 8918677

[51] Int. Cl.[6] ..... G01L 5/00

[52] U.S. Cl. ..... 704/219; 704/229

[58] Field of Search ..... 704/219, 229

[56] References Cited

U.S. PATENT DOCUMENTS 4,797,925 1/1989 Lin ..... 381/36

FOREIGN PATENT DOCUMENTS

| | | | |
|---|---|---|---|
| 0138061 | 4/1985 | European Pat. Off. | G01L 7/08 |
| 0241170 | 10/1987 | European Pat. Off. | G01L 9/14 |
| 0266620 | 5/1988 | European Pat. Off. | G01L 9/14 |
| 2199215 | 6/1988 | United Kingdom | G01L 9/00 |

OTHER PUBLICATIONS

Adoul, J–P., et al., "Fast CELP coding based on algebraic codes," *Proceedings: ICASSP 87—1987 International Conference on Acoustics, Speech, and Signal Processing,* pp. 1957–60 (IEEE Acoustics, Speech and Signal Processing Society, Apr. 1987).

Bottau, F., et al., "On Different Vector Predictive Coding Schemes and Their Application to Low Bit Rates Speech Coding," *Signal Processing IV: Theories and Applications—Proceedings of EUSIPCO–88, Fourth European Signal Processing Conference,* pp. 871–874 (EURASIP, Sep. 1988).

Jayant, N.S., et al., "Speech coding with time–varying bit allocations to excitation and LPC parameters," *Proceedings: ICASSP 89—1989 International Conference on Acoustics, Speech, and Signal Processing,* pp. 65–68 (IEEE Acoustics, Speech and Signal Processing Society, May 1989).

Klejin, W.B., et al., "An efficient stochastically excited linear predictive coding alogorithm for high quality bit rate transmission of speech," *Speech Communication*, vol. 7, No. 3, pp. 305–316 (Oct. 1988).

Le Guyader, A., et al., "A robust and fast CELP encoder at 16 Kbits/s," *Speech Communication*, vol. 7, No. 2, pp. 217–226 (Jul. 1988).

Lin, D., "New Approches to Stochastic Coding of Speech Sources at Very Low Bit Rates," *Signal Processing III: Theories and Applications—Proceedings of EUSIPCO–86, Third European Signal Processing Conference,* pp. 445–448 (EURASIP, Sep. 1986).

Lin, D., "Speech Coding Using Efficient Pseudo–Stochastic Block Codes," *Proceedings: ICASSP 87—1987 International Conference on Acoustics, Speech, and Signal Processing,* pp. 1354–1357 (IEEE Acoustics, Speech and Signal Processing Society, Apr. 1987).

Müller, J.–M., "Improving performance of code excited LPC–coders by joint optimization," *Speech Communication*, vol. 8, No. 4, pp. 363–369 (Dec. 1989).

*Primary Examiner*—D. R. Hudspeth

[57] ABSTRACT

A speech coding system of the code excited linear prediction (CELP) type includes apparatus (24,26) for filtering digitized speech samples to form perceptually weighed speech samples. Entries in a one-dimensional codebook (110) comprising frame length sequences are filtered in a perceptually weighted synthesis filter (28) to form a one-dimensional filtered codebook. The filtered codebook entries are compared with the percerptually weighted speech signals to obtain a codebook index which gives the minimum perceptually weighted error when the speech is resynthesized. Using a one-dimensional codebook (110) reduces the amount of computation which is required compared to the use of a two-dimensional codebook.

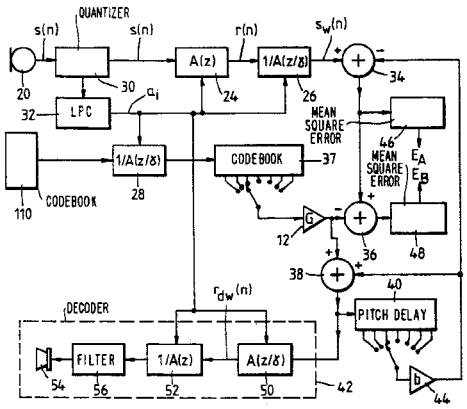

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 6–10, 16–19, 25, 26, 27, 28 and 29 is confirmed.

Claims 1, 11–15, 20, and 30–33 are cancelled.

Claims 2, 21 and 34 are determined to be patentable as amended.

Claims 3–5 and 22–24, dependent on an amended claim, are determined to be patentable.

New claim 35 is added and determined to be patentable.

2. A system as claimed in claim [1] *35*, wherein the means for filtering the codebook entries comprises a perceptual weighting filter.

21. A system as claimed in claim [1] *35*, wherein the means for filtering the digitized speech signal samples comprises a short term predictor and a further perceptual weighting filter, and means for deriving coefficients for short term predictor and for the perceptual weighting filter by linear predictive analysis of the digitised speech samples.

34. A system as claimed in claim [1] *35* wherein the means for comparing the filtered codebook entries with the perceptually weighted speech signals is adapted to search every pth entry, where p is greater than unity.

*35. A speech coding system comprising:*

*means for filtering digitized speech samples to form perceptually weighted speech signal samples;*

*a one dimensional codebook;*

*means for filtering entries read out from the codebook;*

*means for comparing the filtered codebook entries with the perceptually weighted speech signals to obtain a codebook index which gives the minimum perceptually weighted error when the speech is resynthesized;*

*means for obtaining a synthesized speech signal which includes pitch components; and*

*means for comparing the synthesized speech signal with a signal related to the perceptually weighted speech signal to obtain pitch prediction parameters which give a minimum error response.*

* * * * *